US009387977B1

(12) United States Patent
Blake

(10) Patent No.: US 9,387,977 B1
(45) Date of Patent: Jul. 12, 2016

(54) DUAL FUNCTIONING COMBINATION NON CLOG ACTUATOR WITH VALVE ASSEMBLY FOR BAG-VALVE AND CANISTER-ON-VALVE ASSEMBLED SYSTEMS UTILIZING COMPRESSED AIR OR GASES

(76) Inventor: William Sydney Blake, Linwood, NJ (US)

( * ) Notice: Subject to any disclaimer, the term of this patent is extended or adjusted under 35 U.S.C. 154(b) by 541 days.

(21) Appl. No.: 13/506,876

(22) Filed: May 22, 2012

(51) Int. Cl.

| | |
|---|---|
| ***B05B 7/00*** | (2006.01) |
| ***B05B 9/00*** | (2006.01) |
| ***B05B 9/03*** | (2006.01) |
| ***B05B 12/00*** | (2006.01) |
| ***B05B 12/02*** | (2006.01) |
| ***B05B 12/14*** | (2006.01) |
| ***B65D 83/44*** | (2006.01) |
| *B65D 83/20* | (2006.01) |
| *B65D 83/48* | (2006.01) |

(52) U.S. Cl.
CPC ..... *B65D 83/44* (2013.01); *B65D 83/20* (2013.01); *B65D 83/48* (2013.01)

(58) Field of Classification Search
USPC ..... 239/337, 321, 399, 333, 569–571, 239/581.1, 581.2
See application file for complete search history.

(56) References Cited

U.S. PATENT DOCUMENTS

| | | | | |
|---|---|---|---|---|
| 4,020,979 A * | 5/1977 | Shay et al. | ..... | 222/211 |
| 4,396,152 A * | 8/1983 | Abplanalp | ..... | B05B 7/0458 222/402.18 |
| 5,110,052 A * | 5/1992 | Graf | ..... | B05B 7/0416 239/333 |
| 5,150,841 A * | 9/1992 | Silvenis | ..... | B05B 7/0018 137/512.4 |

* cited by examiner

*Primary Examiner* — Arthur O Hall
*Assistant Examiner* — Christopher R Dandridge
(74) *Attorney, Agent, or Firm* — Dennis H. Lambert

(57) ABSTRACT

A dual function aerosol valve assembly has a valve housing with first and second stem valves mounted for reciprocation within it. The first stem valve controls flow of gaseous propellant and the second stem valve is coaxially received within the first stem valve and controls flow of product. An actuator and nozzle assembly is connected with the stem valves so that the first stem valve is opened to admit propellant to the nozzle upon initial depression of the actuator, and the second stem valve is then opened to admit product to the nozzle. Closing of the stem valves is in reverse order so that flow of product to the nozzle is first interrupted and then flow of propellant is interrupted. A spring biases the stem valves to their closed positions. The valve housing is constructed to accommodate either a bag-on-valve system or a piston system.

19 Claims, 16 Drawing Sheets

DUAL FUNCTIONING COMBINATION NON CLOG ACTUATOR WITH VALVE ASSEMBLY FOR BAG-VALVE AND CANISTER-ON-VALVE ASSEMBLED SYSTEMS UTILIZING COMPRESSED AIR OR GASES

BACKGROUND OF THE INVENTION

1. Field of the Invention

The present invention relates to a particular apparatus and method of manufacturing actuators, valves and containers that in combination serve the same results as the embedded propellant, within a product, aerosol system that does not cause detriment or adverse reaction to the environment. More specifically, what is needed is an aerosol system known to industry as bag-on-valve or piston-driven-canister with additional features of non-clogging and not having to use the existing propellants that pose adverse conditions to the atmosphere. Paints, liquid adhesives, starches, hair sprays and any products that have clogging issues are perfect candidates for this invention as well as products that need a preservative. Any adverse issues due to storage and extended shelf life requirements can now be addressed or eliminated. The pressure source and product source can now be separated and there is no need for venting. This unmixed state remains as is until it is mixed at t4e nozzle, allowing for optimum results and efficacy.

2. Description of the Related Art

A number of systems, some as described above, have developed over the years, some utilize special aerosol containers with high pressure propellant driven systems, others, are alternatives that eliminate some of the problems but do not offer the same convenience as aerosols. All dispense a variety of products. While these devices typically work well initially, they typically become partially or fully clogged as the product being dispensed becomes dry and hardens in various flow channels and or orifice. Many other actuators rely on mechanical force, such as a spring or other mechanism, to open an orifice and flow channels for dispensing by withdrawing a probe or plug from the orifice and then closing the orifice after dispensing the product by moving the probe or plug back towards or into the orifice. Aerosols are hazardous, expensive, not to mention the liabilities at stake. So far, the majority of systems still have clogging issues as well as shipping and handling constraints which causes extra care in getting to the market place. Actuators that currently exist are subject to clogging due to product formulas as well as how they are constructed. Also the systems that are in use, do not quite meet expected criteria, as lot of data that has been gathered over the years regarding any adversity towards atmospheric conditions still exists. It appears that the time has come for real "GREEN" technology and serious efforts should be considered and implemented. This invention discloses and creates an economic path for real development towards that goal.

By way of example, U.S. Pat. No. 5,198,774 of Lund et al, discloses a combined lock and anti-clog actuator. The locked position cooperates with an anti-clog member, which has a nozzle seal for inhibiting the clogging of the product within.

U.S. Pat. No. 5,894,964 of Barnes et al, discloses an inner actuator chamber arranged in a way designed to minimize blockage of the actuator.

U.S. Pat. No. 5,480,095 of Stevenson et al, shows an actuator that attenuates the accumulation of solidified sprayer fluid.

U.S. Pat. No. 5,687,877 of Smolen Jr., discloses a pump dispenser with a check valve that moves forward during the pressure stroke and then closes and pulls liquid back during the suction stroke, minimizing blockage.

U.S. Pat. No. 5,560,544 Of Merrit et al, discloses an anti-clogging atomizer nozzle U.S. Pat. No. 5,358,149 of O'Neill discloses an anti-clogging means similar to U.S. Pat. No. 5,687,877 of Smolen, Jr.

U.S. Pat. No. 4,982,900 of Blake discloses a trigger pump sprayer with several nose piece valve configurations.

U.S. Pat. No. 5,855,322 of Py discloses a one-way valve system that utilizes a swirl chamber with a peripherally deformed expandable outlet flex valve means as part of a pouch reservoir system, in a sealed inclusive assembly.

U.S. Pat. No. 5,110,052 of Graf et al. discloses a pump means employing air assist at the nozzle and requires venting.

U.S. Pat. No. 4,057,176 of Horvath discloses a pump means that similar to Graf et al. provides air assist to the nozzle and requires venting.

Despite the efforts of such devices as shown in the forgoing patents. There remains a need for a system that provides anti- or non-clogging features combined with an aerosol system that can reduce a depending pressure-force and avoid need having a propellant embedded within the product to be dispensed, while offering the same convenience as current aerosols provide. Many other attempts have been made and are available in the form of bag-on-valve and piston driven can-on-valve systems but do not offer air assist at the nozzle, with non-clogging ability utilizing a very low pressure as well.

Therefore, there is still that need throughout the Industry. Pumps and mechanically pressurized systems do not provide or employ combined elements that afford the Aerosol convenience of only the depressing of an actuator to achieve atomization, without the use of embedded propellants, which are now being scrutinized more each day, on their harmful reaction to the atmosphere. Liabilities and associated costs are considerations that come into play as well.

SUMMARY OF THE INVENTION

It is an object of the present invention to provide a method for the apparatus, that can be manufactured economically while maintaining all the features of non-clogging and a positive shutoff as well as employing a very low pressure gas driven system without having to use harmful high pressure vessels having embedded within the products, propellants, while still achieving comparable results as provided by the current aerosol systems.

It is another object of the present invention to utilize a low pressure source that provides an air assist at the nozzle for atomization along with non-clog features. It is another object of the present invention to offer a combination of a valve and actuator means that provides a system that supports the air assist at the actuator nozzle.

It is another object of the present invention to offer the same combination of valve and actuator to be employed by bag-on-valve and piston driven can-on-valve systems.

It is further an object of the present invention to offer the convenience of having the option to employ a substitute pressure vessel other than a metal type which allows for various shapes to enhance aesthetic values over a wide range of products.

It is yet another object of the present invention to create a greater value level as well as an economic edge in shipping and shelf life-storage.

It is another object of the present invention that allows the market place to retain the conveniences of aerosols over pumps and other alternatives.

It is a related object of this present invention to make and offer innovative designs that are more flexible to handle a wider range of viscosities.

It is again, another object of this present invention to further provide the edge aerosols held in the conveniences' they maintained for decades without harm to the atmosphere.

To achieve the forgoing and other objects and in accordance with the purposes of the present invention, as embodied and broadly described herein, an actuator assembly combined with a mixing valve assembly that together, offer non clogging and air assist at the nozzle while keeping the product to be dispensed separate from the pressure-force supply until at the actuator nozzle, it becomes mixed. The Actuator assemblies with various nozzles of selection can be referenced by embodiments exhibited throughout U.S. Pat. No. 6,609,666, U.S. Pat. No. 6,543,703 or U.S. Pat. No. 4,982,900 and also shown within figures that offer the means to support the exhibited mixing valve assembly below with any of the actuator assemblies that constitutes dual functioning assemblies, specifically combined in tandem, that achieves the intention of keeping product isolated from its pressure source until it is mixed at the actuator nozzle. These attributes are compatible with a series of systems such as bag-on-valve or piston driven can-on-valve that allows for innovative design in the categories of custom plastic low pressure vessels, selection of various gases as sources to propel the product via compression bags or compression driven piston within a cylinder that provides isolation of pressure from product until it is mixed or combined at the actuator nozzle via two separate paths within the actuator directed by a dual function valve with two separate sequential paths, one for the pressure and the other for the isolated product. This specific combination is achieved between the valve and actuator accordingly. There are other features that allow the different components that construct each assembly by means that enables the component(s) itself to have innovative geometry that impacts the flow paths through the combination by adjusting their cross sectional areas and not there place in their overall fit within their assigned positions.

While addressing the aforementioned, there is further innovation offered by ways and means in selecting the vessels that make up the entire system in tandem. Vessels of various plastics that may withstand the required much lower pressures now offered to deliver the products. Also the offer of means that attach the actuator-valve assemblies through varying configured neck finishes as well as options to select from, at a lower pressure level with products within these processes in tandem and sequentially delivered through the valve. With all the embodiments as described there are attributes that put them in categories for dispensing products that were difficult unless embedded propellant driven aerosol devices were implemented. Now with the aeration and mix of air or gas as provided at the actuator assembly nozzle products such as mousse, shaving creams, liquid gels, certain food groups plus any clogging products may be dispensed using very low pressures that are now isolated until they are mixed through the nozzle combinations being utilized for the present invention as offered.

Other features and advantages of the present invention will become clear from the following detailed description and drawings of particular embodiments of the actuator assemblies and in tandem valve assemblies as combined systems and method associated with them, to provide the intended features of the present invention for the bag-on-valve and piston driven can-on-valve.

BRIEF DESCRIPTION OF THE DRAWINGS

The accompanying drawings, which are incorporated in and form a part of the specification, illustrate the preferred embodiments of the present invention, and together with the description, serve to explain the principles of the invention. In the Drawings.

DETAILED DESCRIPTION OF THE INVENTION

Figure 1:
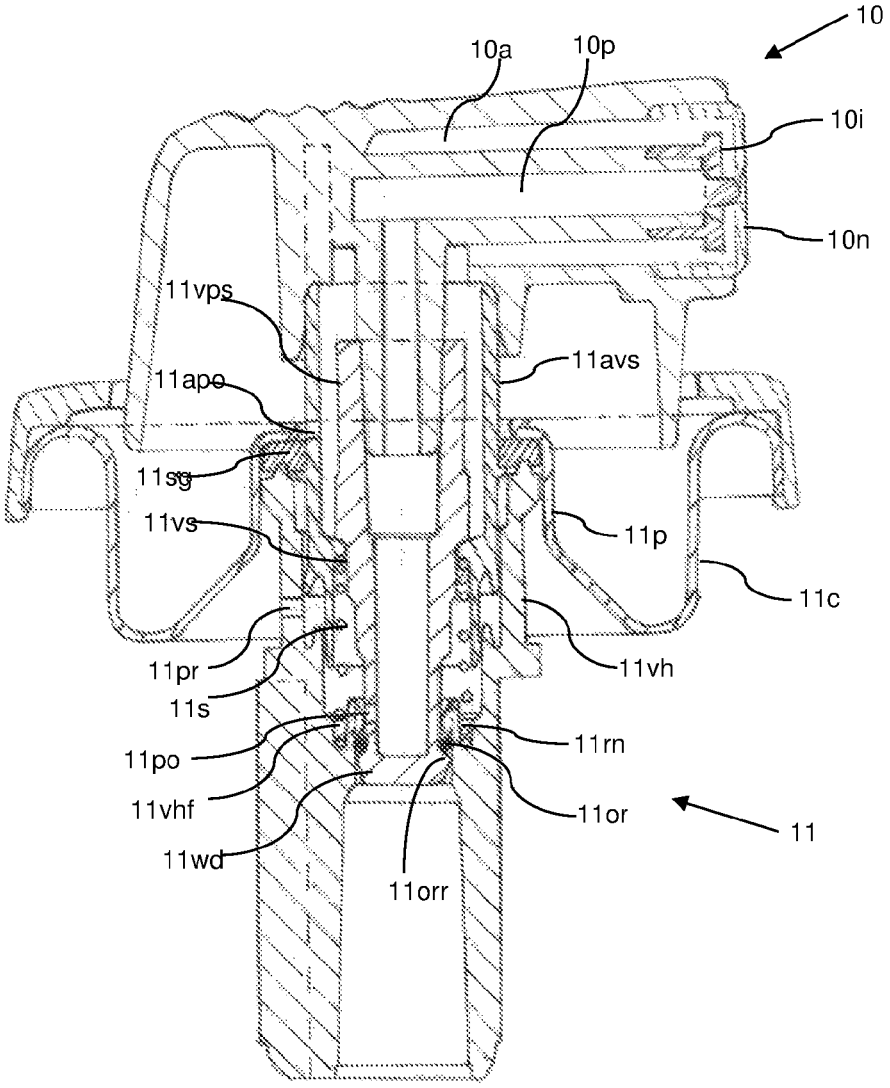
FIG. 1 is cross sectional view of the preferred embodiment of the combined actuator assembly with valve assembly at rest without a product bag or cylinder being shown in place.

In one aspect, the invention is a dual function aerosol valve system, comprising:

(a) a valve cup having means for attachment to a container holding a pressurized gas propellant and a product to be dispensed;

(b) a valve housing having an upper end and a lower end and assembled at its upper end to said valve cup and depending therefrom so that said valve housing extends into a container when said valve cup is assembled to a container, said valve housing having a tubular side wall with an inner surface and an upper end and a lower end, the lower end of said hollow interior defining a first product flow path, wherein said valve housing is constructed so that a bag-on-valve system or to a piston system can be applied to it;

(c) first seal means engaged between said valve housing upper end and said valve cup;

(d) a first stem valve having upper and lower ends and a tubular side wall with a hollow interior and an inner surface, said first stem valve being reciprocal in the valve housing and defining between it and the valve housing upper end a first propellant flow path, said first stem valve side wall being slidable within and sealed relative to said first seal means;

(e) a second stem valve coaxially received within the hollow interior of said first stem valve and being free of attachment to said first stem valve, said second stem valve having upper and lower ends and a tubular side wall with a hollow interior defining a second product flow path, and the upper ends of said first and second stem valves defining between them a second propellant flow path;

(f) second seal means engaged between the lower end of said second stem valve and an interior surface of said valve housing side wall;

(g) a first propellant side port extending through the side wall of said valve housing into the first propellant flow path;

(h) a second propellant side port extending through the side wall of said first stem valve into the second propellant flow path;

(i) a product side port extending through the side wall of said second stem valve into the second product flow path;

(j) spring means engaged with said stem valves to urge them into a first, at-rest position where the first seal means blocks communication through said second propellant port from said first propellant flow path to said second propellant flow path, and said second seal means blocks communication through said product side port from said first product flow path to said second product flow path; and (k) an actuator and nozzle means assembly connected with said stem valves to reciprocate them in said valve housing into a second, depressed dispensing position wherein the second propellant side port moves into an unblocked position relative to said first seal means so that propellant can flow from said first propellant flow path to said second propellant flow path, and said product side port moves into an unblocked position relative to said second seal means so that product can flow from said first product flow path to said second product flow path, said propellant and product side ports being spaced relative to said first and second seal means so that when said actuator is depressed said first stem valve first moves to an open position wherein said second propellant side port is unblocked and then said second stem valve moves to an open position wherein said product side port is unblocked, said first and second stem valves thereby being sequentially opened when said actuator is depressed and sequentially closed in reverse order when said actuator is released, whereby propellant gas flows through said actuator and nozzle means before product and flows through said actuator and nozzle means after flow of product is interrupted.

The actuator defines a propellant flow path extending from said second propellant flow path to said nozzle means, and a product flow path extending from said second product flow path to said nozzle means, said propellant and product remaining separate until they reach the nozzle means where they are mixed and dispensed as a spray.

The first and second stem valves are attached to said actuator so they reciprocate in unison when said actuator is reciprocated and the first stem valve has a downwardly facing first shoulder on its inner surface. The valve housing has an upwardly facing second shoulder on its inner surface at a location between said first product flow path and said first propellant flow path, and the spring means is engaged between said first and second shoulders to bias said stem valves and actuator upwardly relative to said valve housing and valve cup.

The first shoulder defines a center opening in said first stem valve, the second shoulder defines a center opening in said valve housing, and the lower end of said second stem valve has a reduced diameter relative to the upper end thereof, said reduced diameter lower end extending through the center openings defined by said shoulders.

A plurality of upstanding retaining nibs are formed on said second shoulder, and the second stem valve lower end has a radially enlarged head, said nibs being engaged behind said head to retain said second stem valve in said valve housing against the bias of said spring means.

The second seal means comprises an O-ring seal engaged around said lower end of said second stem valve at said enlarged head, and the first seal means comprises a diaphragm seal gasket compressed between the upper end of said valve housing and said valve cup.

The valve cup has an upstanding central pedestal with a central opening therethrough, and said valve housing is secured to said valve cup below and in alignment with said central opening.

In a preferred embodiment, product to be dispensed is contained within a bag attached to said valve housing.

The lower end of said valve housing is open for flow of product axially into said first product flow path, and the upper ends of said first and second stem valves open axially upwardly through the upper end of said valve housing, said second propellant flow path and said second product flow path opening axially upwardly through said open upper ends of said first and second stem valves.

The actuator comprises an actuator base having depending tubular projections attached axially with the open upper ends of said first and second stem valves, said product flow path and said propellant flow path in said actuator extending upwardly through said projections to lateral product and propellant flow paths extending forwardly through said actuator base to said nozzle means. The nozzle means comprises a generally cup-shaped aeration fitment rotatable relative to said actuator base but constrained against axial movement relative thereto, said aeration fitment having a side wall with an open end secured to a forward lateral side of said actuator base in circumscribing relationship to said product and propellant flow paths, and an end wall spaced forwardly of said actuator base, said end wall having a central opening therethrough.

A generally cup-shaped threaded sleeve is secured to said actuator base coaxially within said aeration fitment and being rotatable with said aeration fitment but constrained against axial movement relative to said actuator base, said sleeve having a cylindrical side wall with internal threads and an open end at said actuator base and a forward wall disposed adjacent to and behind the end wall of said aeration fitment, said forward wall having a discharge orifice in alignment with the central opening through the end wall of said aeration fitment, and an adjustable nozzle disposed coaxially within said threaded sleeve, said nozzle being constrained against rotational movement relative to said actuator base but movable axially relative to said actuator base and having external threads engaged with said internal threads in said threaded sleeve so that rotation of said sleeve causes axial movement of said nozzle toward and away from said discharge orifice in the forward wall of said sleeve, said nozzle having a center post that extends forwardly to adjacent said discharge orifice in said forward wall of said threaded sleeve, wherein axial movement of said nozzle adjusts the position of said post relative to said discharge orifice to thereby adjust the spray pattern of product discharged through said discharge orifice.

A propellant flow path is defined between the aeration fitment side wall and the threaded sleeve side wall and between said aeration fitment end wall and said threaded sleeve forward wall, and the adjustable nozzle defines a product flow path extending through a center portion thereof around said center post to the discharge orifice in the forward wall of said threaded sleeve.

In one embodiment of the invention the valve cup is made of metal material, and in other embodiments it can be made of different materials to accommodate the valve assembly and different container neck finishes of a container to which said valve assembly is to be secured.

With the above summary of the assemblies in mind, it may now be helpful in fully understanding the inventive features of the present invention to provide in the following description a thorough and detailed discussion of specific embodiments of the invention.

Figure 2:
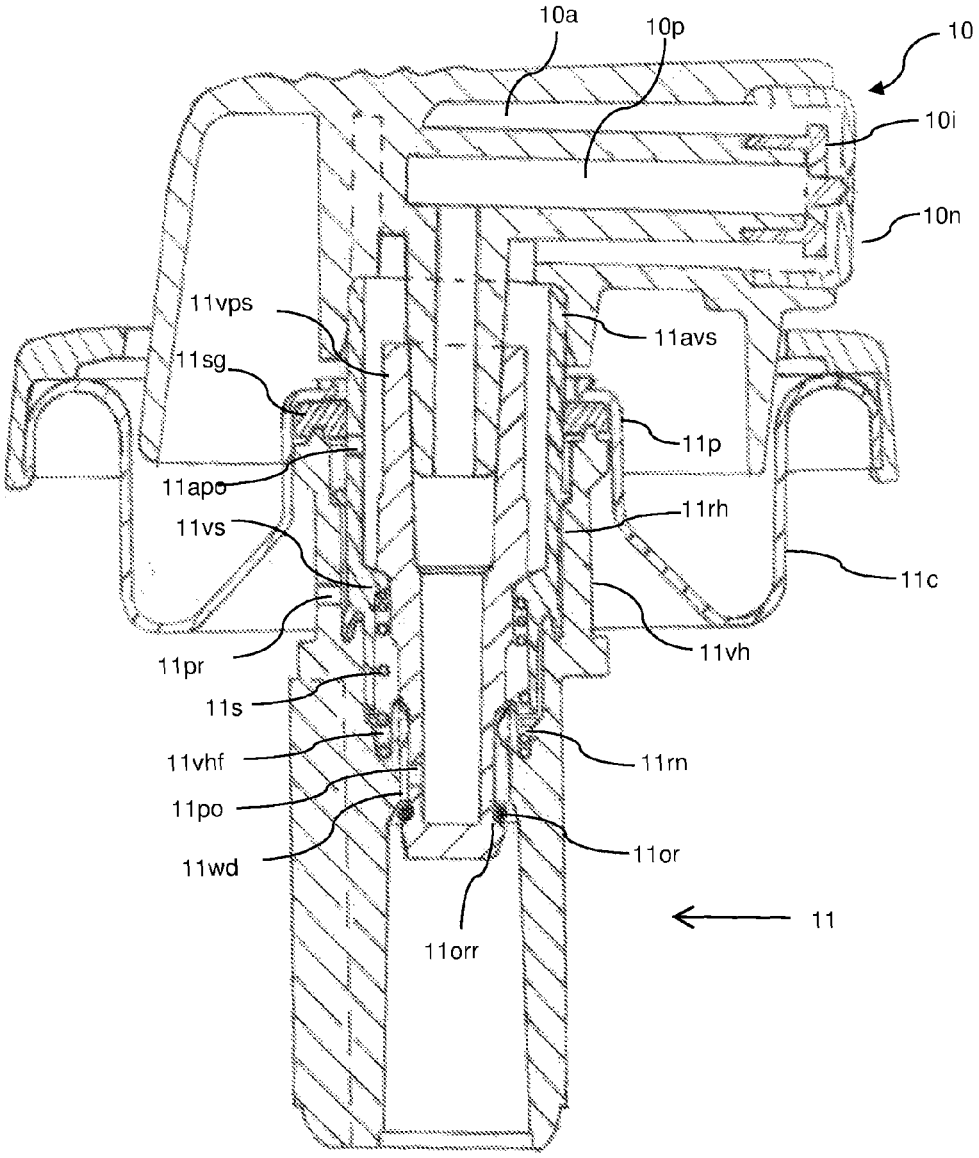
FIG. 2 is a cross sectional view of FIG. 1 but in the filling and or dispensing mode.
Figure 3:
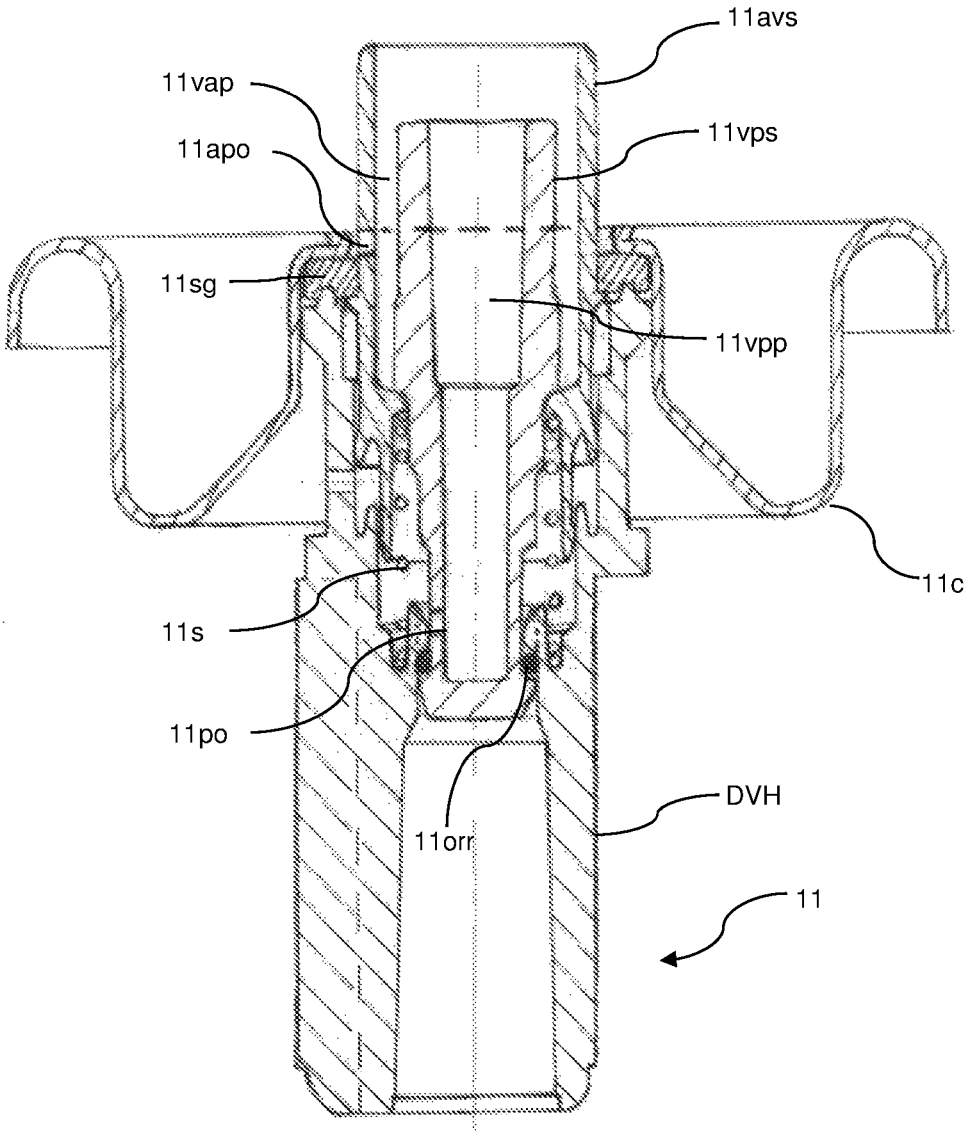
FIG. 3 is a cross sectional view showing the valve assembly as in FIG. 1 without the actuator assembly being shown in place.

Most generally, and referring to FIGS. 1-3, it may be seen in overview that the actuator assembly 10 in accordance to this invention provides two paths, one air path 10*a* and one product path 10*p* which both mix together at the nozzle 10*n* and insert 10*i*, creating a spray. Below the actuator assembly there is a valve assembly 11. The valve assembly is made up of a valve cup 11*c* which has a pedestal 11*p* before crimping which takes place at assembly, and also houses a valve seal gasket 11*sg*, that seals against the upper portion of the valve housing 11*vh*, which retains two stems, one being the air valve stem 11*avs* and the other being the product valve stem 11*vps*, that operate sequentially when the actuator assembly 10 is depressed against the spring 11*s* that fits between the valve housing floor pocket 11*vhf* and the shoulder 11*vs* of the air valve stem 11*avs*. The spring 11*s* normally biases the valve stems to the sealed position as shown in FIG. 1. In the sealed position as shown in FIG. 1, pressure orifice 11*pr* in the side of the valve housing 11*vh* is closed, and in the unsealed position as shown in FIG. 2, orifice 11*pr* is open. There is a set of circumferentially placed retaining nibs 11*rn* that prevents the product valve stem 11*vps* by way of a O'ring 11 or of which is seated in a O'ring race 11*orr* in the base of the product valve stem 11*vps* from unseated as shown. The O'ring also seals within the walls of the diameter 11*wd* beneath the retainer nibs 11*rn*. After the actuator assembly 10 becomes depressed as shown in FIG. 2, air and product is released through the two valve stems sequentially with the air first and last to be emitted. This sequence keeps the system purged along with a feature of anti or non-clogging. There are two separate paths within the valve assembly 11, one being the valve air path 11*vap* and the other the valve product path 11*vpp*, each have their own feed orifices, the valve product orifice 11*po* and the other being the valve air path orifice 11*apo* within the valve air valve stem 11*avs*. With all as described above, the system allows for separation of product and pressure and maintains such until both meet at the nozzle, whereas product is mixed at the orifice at which time a spray occurs. The systems as posed, requires a very low pressure which enables a much lower pressure vessel to be employed while obtaining equivalent spray patterns to aerosols of present means.

FIG. 3 is same as FIGS. 1 & 2 without the actuator assembly 10 being shown but functions in the same manner.

Figure 4:
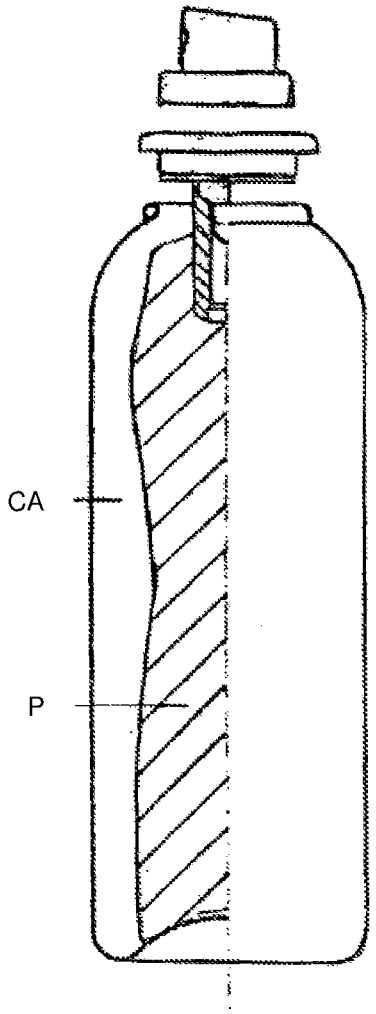
FIG. 4 is an illustrated view of a bag-on-valve package with actuator and valve with bag showing ratio of air to product. Ratios of air may vary with products.

FIG. 4 exhibits a scenario for a bag-on-valve system that would be suited for the present invention as described in FIGS. 1 through 3 as well as other below embodiments.

Figure 5:
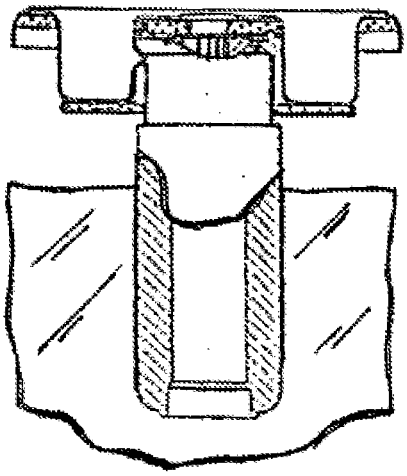
FIG. 5 is another illustrative view in semi cross sectional valve cup with valve housing in cross section with bag location as ferruled out.

FIG. 5 exhibits the way a bag can be applied to a valve similar to FIG. 4 while the application may vary, such as a piston driven can could be substituted.

Figure 6:
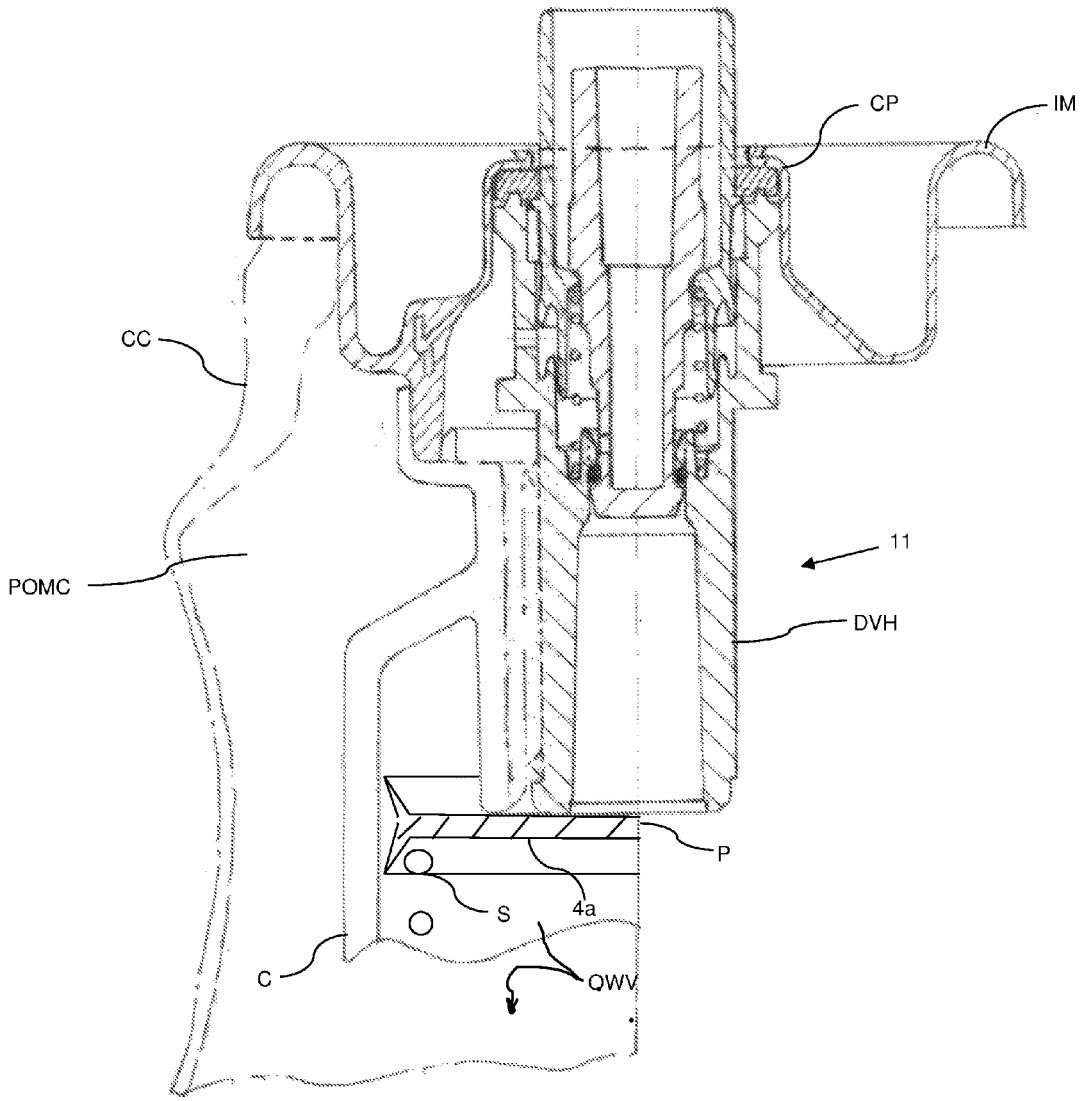
FIG. 6 is a cross sectional view as in FIG. 3 but showing a piston driven can-on-valve attachment to the valve housing with an insert molded-on-cup ferrule configuration in place as well as a customized container illustrated contour.

FIG. 6 exhibits a substitution scenario to FIG. 4 by changing the bag-on-valve to a piston driven cylinder-on-can with a one-way valve in the base. In the embodiment shown in FIG. 6, a piston P with a cylinder C and a custom container CC may be employed to the valve cup in two ways. One way is the conventional crimp on cup or the valve cup pedestal CP could be insert molded IM as a custom means that accommodates a complemental finish to be injected blow molded. Finishes could be crimped, solvent or sonic welded assemblies. A spring S" is used to lift the piston P upwards for pushing the product into the dual valve housing DVH. A one way valve OWV is not shown but is indicated in FIG. 6 by an arrow and located at the base of the product cylinder C and subject to be used to facilitate the pre-charged air cycle of the container POMC before the product is filled into the product chamber area volume. The one way valve allows the usage of the pressure within the chamber to be employed as an effective portion of the initial air preloaded before the product is introduced into the system.

Figure 7:
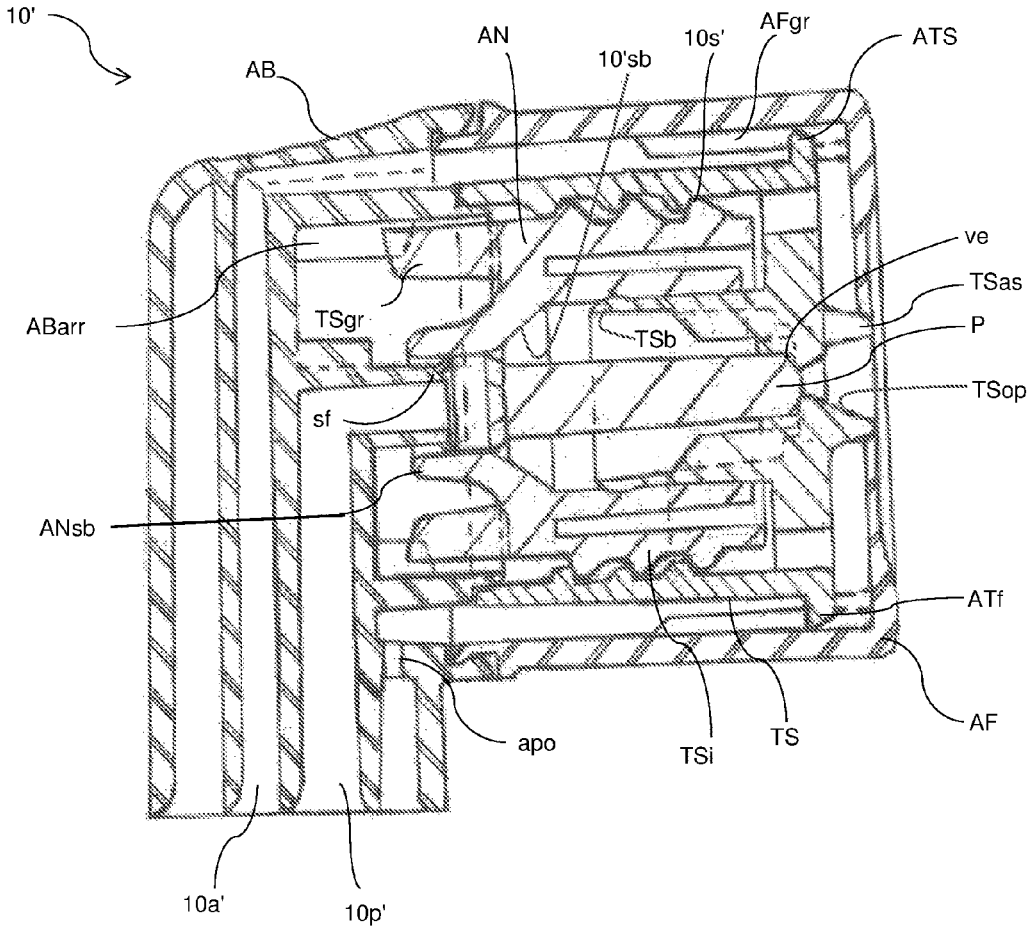
FIG. 7 is a cross sectional view of an actuator assembly of just one mechanical adjusted nozzle means to be used with FIGS. 3 and 6.
Figure 8:
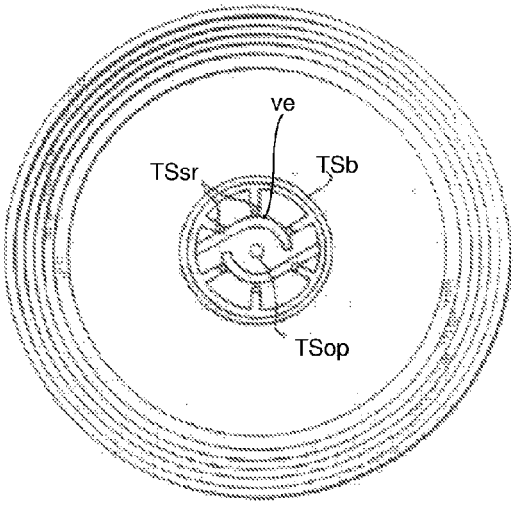
FIG. 8 is a partial view with emphasis on the adjustable eye brow mechanical breakup means used in FIG. 7.

FIGS. 7 and 8 show an actuator assembly 10' with an adjustable nozzle AN within a threaded sleeve TS by way of a turning aerating fitment AF in combination, mounted onto a actuator base AB having double paths, one being the air path 10*a'* and the other being the product path 10*p'*. The adjustable nozzle AN has a threaded outer sleeve 10*s'* that interfaces with a threaded inner sleeve Tsi of the threaded sleeve TS also each part, TS and AF each having guide ribs TSgr engaged with anti-rotational ribs ABarr within the actuator base AB as shown. Aeration fitment AF have guide ribs as shown as AFgr. When the aeration fitment AF is turned, it rotates and the anti-rotational ribs AFgr engages slots ATs within a flange ATf at the leading edge of the threaded sleeve TS, the anti-rotational ribs TSgr extend from the base of the adjustable nozzle AN restrains it from turning and causes the adjustable nozzle AN to ride the interfaced threaded engagement portions of TSi and 10*s'* causing the probe P portion of the 10*s'* to move in and out of the vortex eyebrows ve allowing for an adjustable spray. There is an internal sleeve bore 10'*sb* area within 10*s'* that in conjunction with a sliding sealing bead Tsb as a central part of threaded sleeve TS both Tsb and 10*sb* interfacing with each other while moving within the vortex eyebrows ve within the turning TS. There is an air inlet orifice apo within the actuator base AB that supplies the, air path 10*a'* through angular slots TSas into the orifice pocket TSop of the aeration fitment AF. There is also a sealing flange sf within the actuator base AB that rides within a second bore ANsb at the trailing edge portion of the actuator nozzle AN. There are a series of stabilizer ribs TSsr that surround the eyebrows ve within the threaded sleeve TS as shown in FIG. 8.

Figure 9:
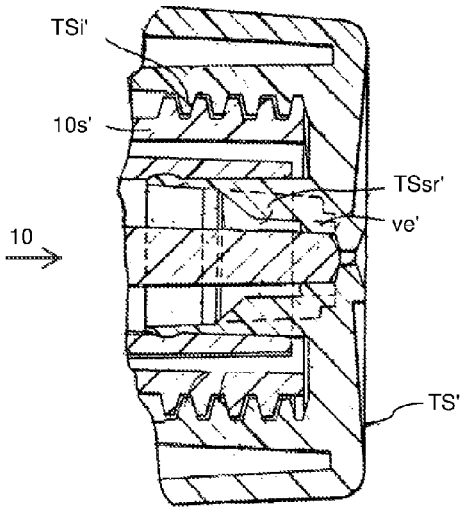
FIG. 9 is a fragmentary view in section of a modification of the nozzle assembly shown in FIG. 8 and incorporating some of the features of the nozzle assembly disclosed in U.S. Pat. No. 4,982,900.
Figure 10:
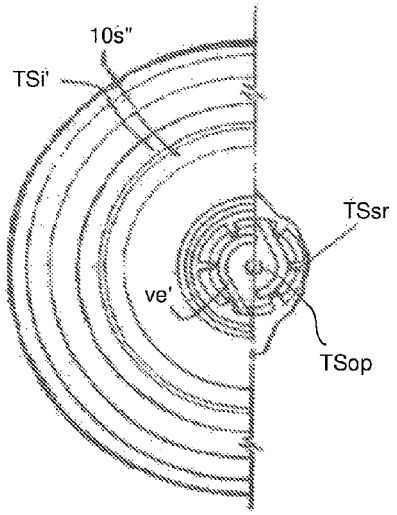
FIG. 10 is a partial view looking in the direction of arrow 10 in FIG. 9.

FIGS. 9 and 10 show an arrangement that is similar to FIGS. 7 and 8 but does not provide aeration fitment AF. The adjustable nozzle TS' is altered to function without AF. All the same features are present for obtaining atomization.

Figure 11:
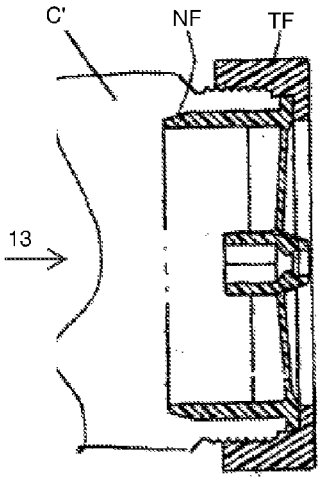
FIG. 11 is cross sectional assembly view illustrating another means as reference using U.S. Pat. No. 6,543,703 that also applies to 7.
Figure 12:
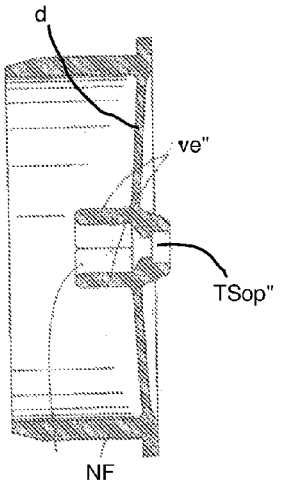
FIG. 12 is a cross sectional view showing only the insert portion of FIG. 10.

FIGS. 11 and 12 show another means available to provide non-clogging action whereas a diaphragm d housed within a nozzle fitment NF configuration employs an adjustable eyebrow ve" centrally located within d that surrounds a probe not shown in FIG. 11 or 12 but shown in FIGS. 7 and 9 as P. FIG. 11 shows the membrane of FIG. 12 being retained by a threaded fitment TF over a container C'

Figure 13:
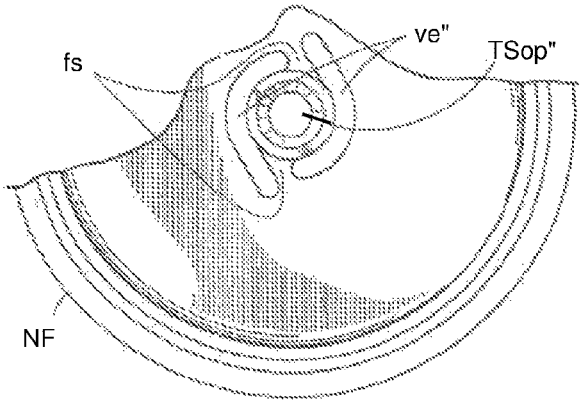
FIG. 13 is an enlarged fragmentary view of the eye brow configuration as illustrated in FIGS. 11 and 12.
Figure 14:
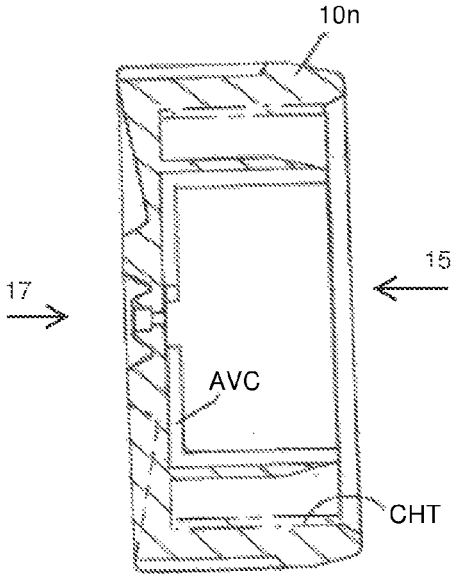
FIG. 14 is a sectional view of the air assist vortex that could be threaded or snapped onto FIG. 1 or 7.

FIG. 13 is an enlarged fragmentary view of the nozzle fitment NF, taken in the direction of arrow 13 in FIG. 12, and in particular showing the feed slots fs that are part of the vortex eyebrows ve" configuration. As in FIGS. 11 and 12, there is no aeration nozzle AN.

Figure 15:
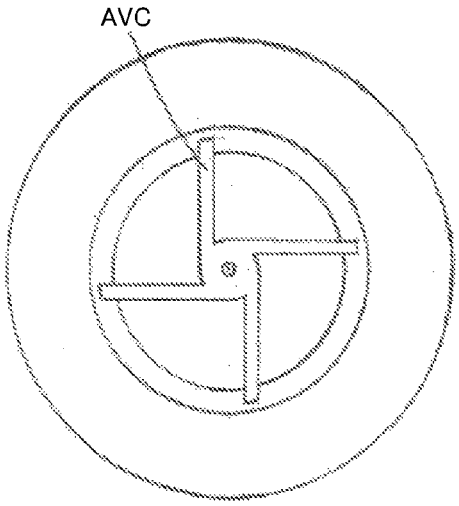
FIG. 15 is a view looking in the direction of the arrow 15 in FIG. 14 but with the threads omitted to emphasize the vortex channels.
Figure 16:
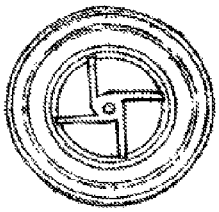
FIG. 16 is a view looking in the direction or arrow 16 in FIG. 18, but with the vortex channels and the threads shown.
Figure 17:
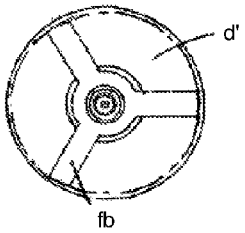
FIG. 17 is an end view looking in the direction of arrow 17 in FIGS. 14 and 18.
Figure 18:
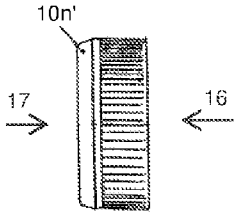
FIG. 18 is a side view in elevation of the air assist vortex shown in FIGS. 14-17.
Figure 19:
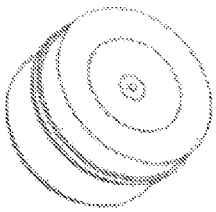
FIGS. 19 and 20 are isometric views of the MBU insert shown in FIG. 24.
Figure 20:
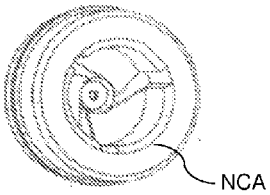
Figure 21:
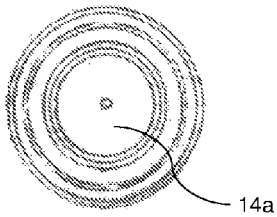
FIG. 21 is the same as FIG. 16 except that it has no vortex channels as in FIG. 15 or 16.
Figure 22:
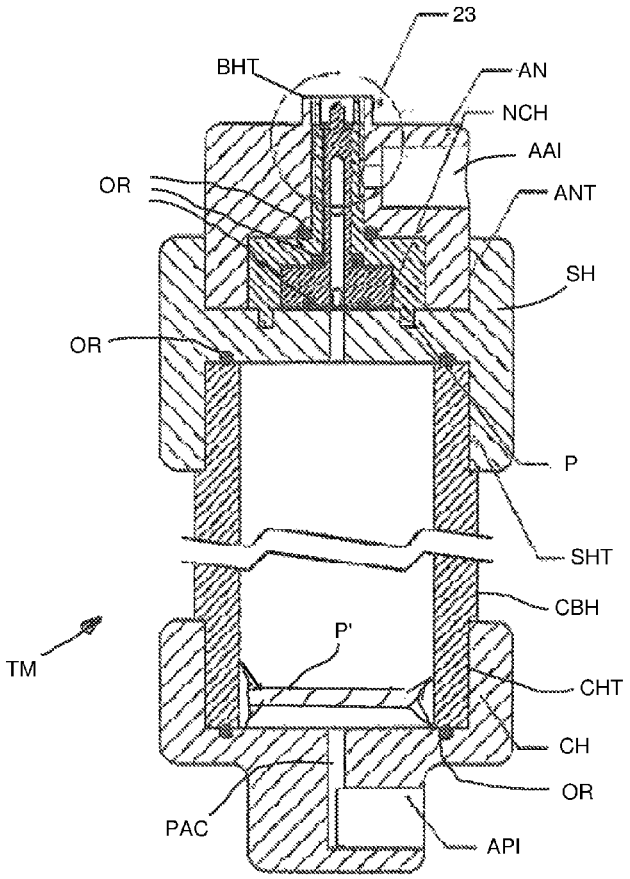
FIG. 22 is cross sectional view of a test module for testing the system as shown in FIGS. 1 through 21.
Figure 23:
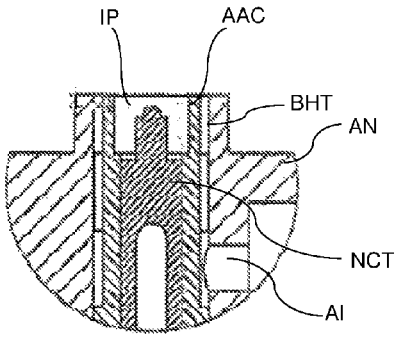
FIG. 23 is a blowup detail of the circled area in FIG. 22 without the insert shown in FIG. 19 or 20 or air vortex fitment shown in FIGS. 14-16.
Figure 24:
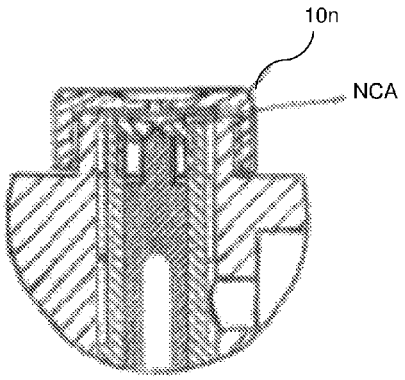
FIG. 24 is a blowup detail similar to FIG. 23 but with the MBU mechanical breakup fitment of FIGS. 19 and 20 in place.
Figure 25D:
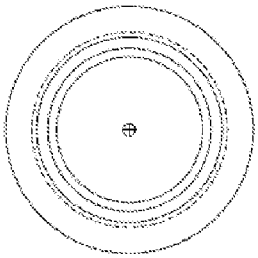
FIG. 25*d* is an end view taken in the direction of the arrow 25*d* in FIG. 25*b*.
Figure 25A:
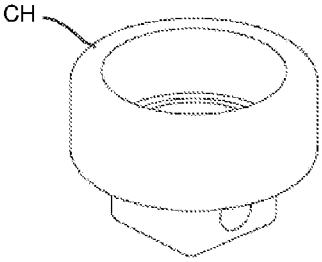
FIG. 25*a* is an isometric view of the back housing, or housing bottom cap, in the test module assembly shown in FIG. 22.
Figure 25B:
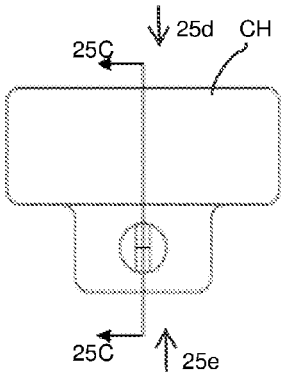
FIG. 25*b* is a side view in elevation of the back housing of FIG. 25*a*.
Figure 25C:
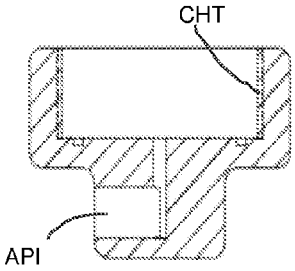
FIG. 25*c* is a longitudinal sectional view taken along line 25*c* in FIG. 25*b*.
Figure 25E:
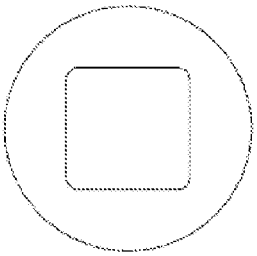
FIG. 25*e* is an end view taken in the direction of the arrow 25*e* in FIG. 25*b*.
Figure 26D:
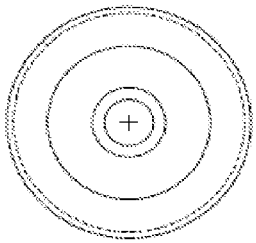
FIG. 26*d* is an end view taken in the direction of the arrow 26*d* in FIG. 26*b*.
Figure 26A:
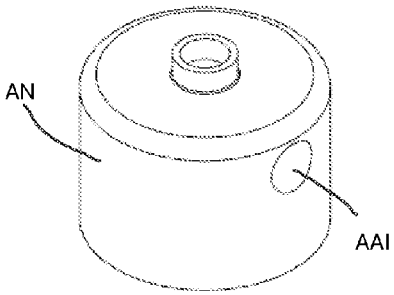
FIG. 26*a* is an isometric view of the housing bottom cap in the test module assembly shown in FIG. 22.
Figure 26B:
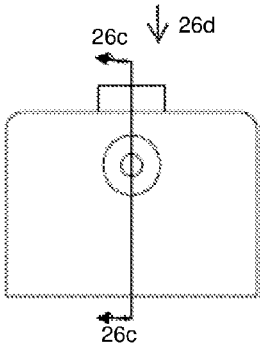
FIG. 26*b* is a side view in elevation of the housing cap of FIG. 26*a.]*
Figure 26C:
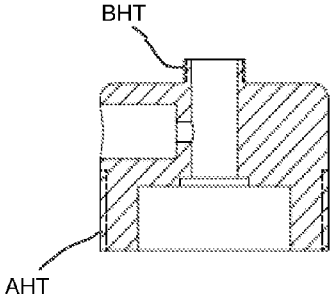
FIG. 26*c* is a longitudinal sectional view taken along line 26*c* in FIG. 26*b*.
Figure 26E:
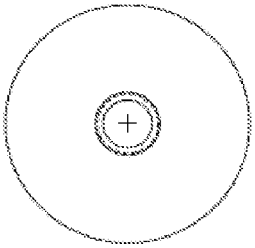
FIG. 26*e* is an end view taken in the direction of the arrow 26*e* in FIG. 26*b*.
Figure 27A:
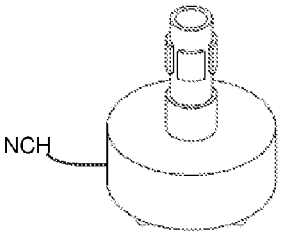
FIG. 27*a* is a top isometric view of the non-clog housing in the test module assembly shown in FIG. 22.
Figure 27B:
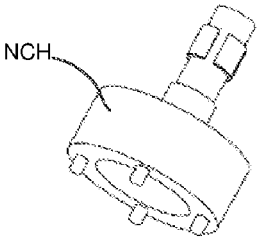
FIG. 27*h* is a bottom isometric view of the non-clog housing.
FIG. 27*c* is a side elevation view of the non-clog housing.
FIG. 27*d* is a longitudinal sectional view taken along line 27*d* in FIG. 27*c*.
FIG. 27*e* is an end view taken in the direction of the arrow 27*e* in FIG. 27*c*.
FIG. 27*f* is an end view taken in the direction of the arrow 27*f* in FIG. 27*c*.
Figure 27C:
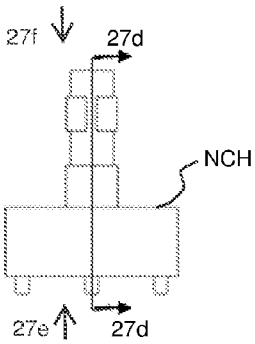
Figure 27D:
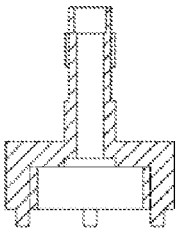
Figure 27E:
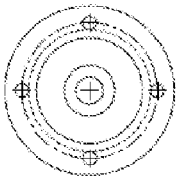
Figure 27F:
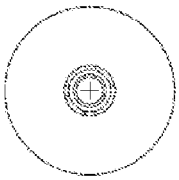
Figure 28A:
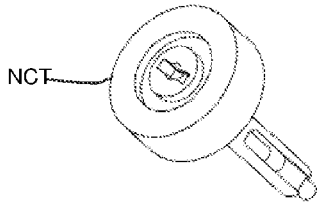
FIG. 28*a* is a bottom isometric view of the non-clog tip in the assembly of FIG. 22.
Figure 28B:
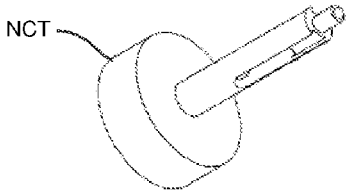
FIG. 28*b* is a top isometric view of the non-clog tip.
Figure 28C:
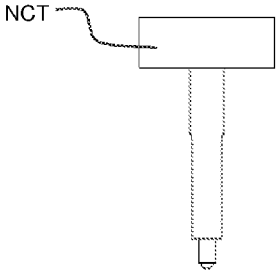
FIG. 28*c* is a side elevation view of the tip of FIG. 28*a*.
Figure 28D:
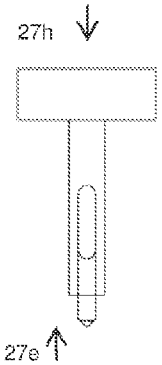
FIG. 28*d* is a side elevation view of the tip, taken at 90 to the view in FIG. 28*c*.
Figure 28E:
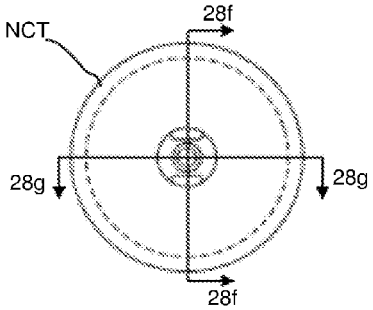
FIG. 28*e* is an end view of the tip, taken in the direction of the arrow 28*e* in FIG. 28*d*.
Figure 28F:
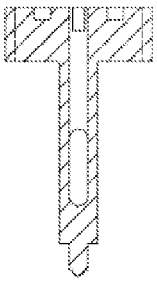
FIG. 28*f* is a longitudinal sectional view taken along line 28*f* in FIG. 28*e*.
Figure 28G:
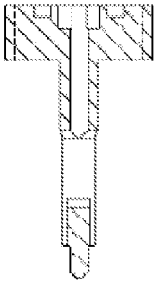
FIG. 28*g* is a longitudinal sectional view taken along line 28*g* in FIG. 28*e*.
Figure 28H:
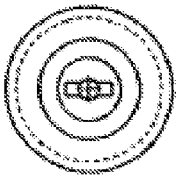
FIG. 28*h* is an end view of the tip, taken in the direction of the arrow 27*h* in FIG. 28*d*.
Figure 29D:
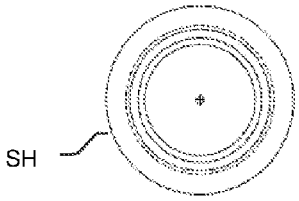
FIG. 29*d* is an end view taken in the direction of the arrow 29*d* in FIG. 29*b*
Figure 29A:
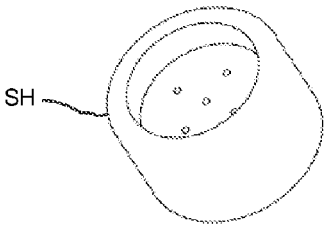
FIG. 29*a* is a top isometric view of the spray housing in the test module shown in FIG. 22.
Figure 29B:
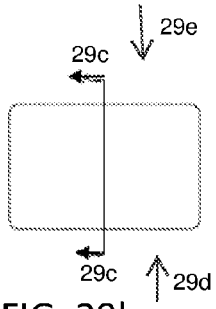
FIG. 29*b* is a side elevation of the spray housing of FIG. 29*a*.
Figure 29C:
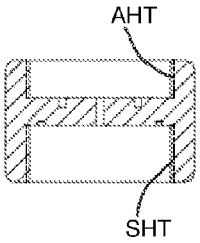
FIG. 29*c* is a longitudinal sectional view taken along line 29*c* in FIG. 29*b*.
Figure 29E:
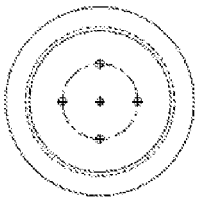
FIG. 29*e* is an end view taken in the direction of the arrow 29*e* in FIG. 29*b*.
Figure 30A:
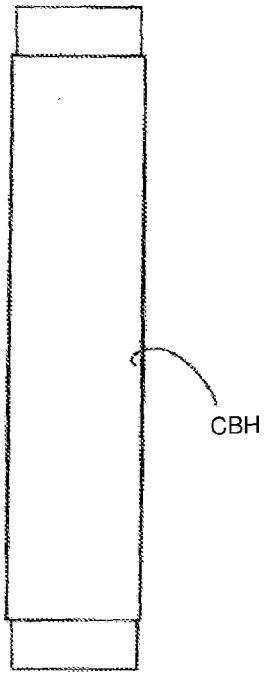
FIG. 30 is a side view in elevation of the cylinder in the test module assembly of FIG. 22.
FIG. 30*b* is a longitudinal sectional view taken along line 30*b* in FIG. 30*c*.
FIG. 30*c* is an end view of the cylinder of FIG. 30*a*.
Figure 30B:
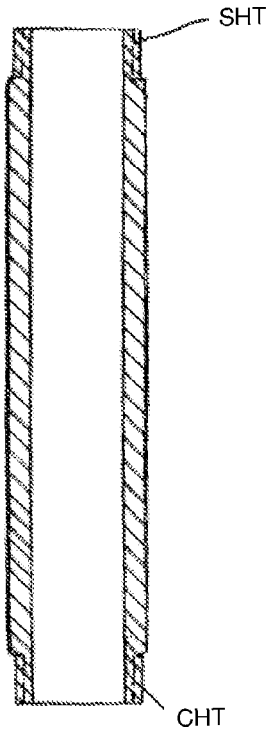
Figure 30C:
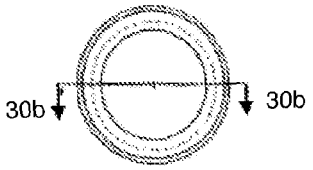

FIGS. 14-18 and FIG. 21, respectively, depict two types of aeration nozzles to be used with FIGS. 1 and 2 as well as FIG. 3. FIGS. 15 and 16 show four aeration vortex channels AVC that receive the air from the non-clog insert NCA shown in FIGS. 19 and 20 to further enhances the spray pattern. FIG. 21 shows the same arrangement but without the aeration vortex channels. The aeration nozzles in both forms have three flex braces fb to support the flexible diaphragm d' required to support a non-clog action, if necessary. Both types have threads for retention onto an actuator in any case. FIG. 15 does not show the threads in the bottom view.

FIGS. 22 through 30*c* are all part of a test module TM composite constructed to prove the principles employed throughout above concepts, and comprise an aeration nozzle AN, non-clog insert NCA, cap housing AN, non-clog housing NCH, non-clog tip NCT, spray housing SH, cylinder bore housing CBH, back housing BH and piston P'. There are two air feeds, top one is AAI and base is API. The AAI feeds air to the actuator nozzle and the API feeds air as applied to the piston P' within the cylinder bore housing CBH. The cylinder bore housing CBH is threaded on both ends at SHT and CHT to retain the cylinder bore housing CBH. The actuator nozzle AN and the cap housing CH each are threaded at ANT and CHT onto the spray housing SH and cap housing CH, locations shown in FIG. 22. The spray housing has internal threads at the top and bottom locations AHT and SHT. There are a number of O'ring seals OR placed at all required seal points within the module. This module does not exhibit the valve assembly 11 as shown in FIGS. 1-3 which delivers the sequential feed of air and product, releasing air first and last to be emitted from the valve assembly 11 into the actuator assembly 10 as shown in FIGS. 1 and 2. This module TM directs the two air feeds according to FIGS. 1, 2 and 3 but instead, the product and air travels directly onto the piston within the cylinder and to the nozzle orifice of the actuator assembly where it becomes mixed and atomized to demonstrate the results intended and as shown in FIGS. 1 and 2.

Accordingly, resort may be made to all suitable modifications and equivalents that fall within the scope of the present invention as defined by the claims which follow. The words "comprise", "comprising", "include(s)", and "including" when used in this specification and in the following claims are intended to specify the presence of stated feature or steps, but they do not preclude the presence or addition of one or more other features or means, steps or groups thereof.

What is claimed is:

1. A dual function aerosol valve system, comprising:

(a) a valve cup having means for attachment to a container holding a pressurized gas propellant and a product to be dispensed;

(b) a valve assembly and an actuator and nozzle means assembly mounted to said valve cup, said valve assembly being below said valve cup and said actuator and nozzle means assembly being above said valve cup;

(c) said valve assembly including a valve housing having an upper end and a lower end and assembled at its upper end to said valve cup and depending therefrom so that said valve housing extends into a container when said valve cup is assembled to a container, said valve housing having a tubular side wall with an upper end and a lower end and an inner surface defining a hollow interior, a lower end of said hollow interior defining a first product flow path, wherein said valve housing is constructed so that a bag-on-valve system or a piston system can be applied to said valve housing;

(d) first seal means engaged between said valve housing upper end and said valve cup;

(e) a first stem valve having upper and lower ends and a tubular side wall with a hollow interior and an inner surface, said first stem valve being reciprocal in the valve housing and defining between it and the valve housing upper end a first propellant flow path, said first stem valve being open ended and its side wall being slidable within and sealed relative to said first seal means;

(f) a second stem valve coaxially received within the hollow interior of said first stem valve and being free of attachment to said first stem valve, said second stem valve having upper and lower ends and a tubular side wall with a hollow interior defining a second product flow path, the upper end of said second stem valve being open and the lower end being closed, and the upper ends of said first and second stem valves defining between them a second propellant flow path;

(g) second seal means engaged between the lower end of said second stem valve and an interior surface of said valve housing side wall;

(h) a first propellant side port extending through the side wall of said valve housing into the first propellant flow path;

(i) a second propellant side port extending through the side wall of said first stem valve into the second propellant flow path;

(j) a product side port extending through the side wall of said second stem valve into the second product flow path;

(k) spring means engaged with said stem valves to urge them into a first, at-rest position where the first seal means blocks communication through said second propellant port from said first propellant flow path to said second propellant flow path, and said second seal means blocks communication through said product side port from said first product flow path to said second product flow path; and (l) said actuator and nozzle means assembly is connected with each of said stem valves to reciprocate them in said valve housing into a second, depressed dispensing position wherein the second propellant side port moves into an unblocked position relative to said first seal means so that propellant can flow from said first propellant flow path to said second propellant flow path, and said product side port moves into an unblocked position relative to said second seal means so that product can flow from said first product flow path to said second product flow path, said propellant and product side ports being spaced relative to said first and second seal means so that when said actuator is depressed said first stem valve first moves to an open position wherein said second propellant side port is unblocked and then said second stem valve moves to an open position wherein said product side port is unblocked, said first and second stem valves thereby being sequentially opened when said actuator is depressed and sequentially closed in reverse order when said actuator is released, whereby propellant gas flows through said actuator and nozzle means before product and flows through said actuator and nozzle means after flow of product is interrupted.

2. The dual function aerosol valve system claimed in claim 1, wherein:

said actuator defines a propellant flow path extending from said second propellant flow path to said nozzle means, and a product flow path extending from said second product flow path to said nozzle means, said propellant and product remaining separate until they reach the nozzle means where they are mixed and dispensed as a spray.

3. The dual function aerosol valve system claimed in claim 2, wherein:

said first and second stem valves are attached to said actuator so they reciprocate in unison throughout their travel when said actuator is reciprocated.

4. The dual function aerosol valve system claimed in claim 3, wherein:

said first stem valve has a downwardly facing first shoulder on its inner surface;

said valve housing has a reduced diameter section on its inner surface defining an elongate cylindrical valve seat and an upwardly facing second shoulder at a location between said first product flow path and said first propellant flow path; and said spring means is engaged between said first and second shoulders to bias said stem valves and actuator upwardly relative to said valve housing and valve cup.

5. The dual function aerosol valve system claimed in claim 4, wherein:

said first shoulder defines a center opening in said first stem valve;

said second shoulder defines a center opening in said valve housing; and said lower end of said second stem valve has a reduced diameter relative to the upper end thereof, said reduced diameter lower end extending through the center openings defined by said first and second shoulders.

6. The dual function aerosol valve system claimed in claim 5, wherein:

a plurality of upstanding retaining nibs is formed on said second shoulder; and said second stem valve lower end has a radially enlarged head, said nibs being engaged behind said head to retain said second stem valve in said valve housing against the bias of said spring means.

7. The dual function aerosol valve system claimed in claim 6, wherein:

said second seal means comprises an O-ring seal engaged around said lower end of said second stem valve at said enlarged head for sliding sealing engagement with said cylindrical valve seat.

8. The dual function aerosol valve system claimed in claim 7, wherein:

said first seal means comprises a diaphragm seal gasket compressed between the upper end of said valve housing and said valve cup.

9. The dual function aerosol valve system claimed in claim 8, wherein:

said valve cup has an upstanding central pedestal with a central opening therethrough, and said valve housing is secured to said valve cup below and in alignment with said central opening.

10. The dual function aerosol valve system claimed in claim 9, wherein:

product to be dispensed is contained within a bag attached to said valve housing.

11. The dual function aerosol valve system claimed in claim 1, wherein:

the lower end of said valve housing is open for flow of product axially into said first product flow path.

12. The dual function aerosol valve system claimed in claim 2, wherein:

the upper ends of said first and second stem valves open axially upwardly through the upper end of said valve housing, said second propellant flow path and said second product flow path opening axially upwardly through said open upper ends of said first and second stem valves; and said actuator comprises an actuator base having depending tubular projections, each of which is attached axially with a respective one of the open upper ends of said first and second stem valves, said product flow path and said propellant flow path in said actuator extending upwardly through said projections to lateral product and propellant flow paths extending forwardly through said actuator base to said nozzle means.

13. The dual function aerosol valve system claimed in claim 12, wherein:

said nozzle means comprises a generally cup-shaped aeration fitment rotatable relative to said actuator base but constrained against axial movement relative thereto, said aeration fitment having a side wall with an open end secured to a forward lateral side of said actuator base in circumscribing relationship to said product and propellant flow paths, and an end wall spaced forwardly of said actuator base, said end wall having a central opening therethrough;

a generally cup-shaped threaded sleeve secured to said actuator base coaxially within said aeration fitment and being rotatable with said aeration fitment but constrained against axial movement relative to said actuator base, said sleeve having a cylindrical side wall with internal threads and an open end at said actuator base and a forward wall disposed adjacent to and behind the end wall of said aeration fitment, said forward wall having a discharge orifice in alignment with the central opening through the end wall of said aeration fitment; and an adjustable nozzle disposed coaxially within said threaded sleeve, said nozzle being constrained against rotational movement relative to said actuator base but movable axially relative to said actuator base and having external threads engaged with said internal threads in said threaded sleeve so that rotation of said sleeve causes axial movement of said nozzle toward and away from said discharge orifice in the forward wall of said sleeve, said nozzle having a center post that extends forwardly to adjacent said discharge orifice in said forward wall of said threaded sleeve, wherein axial movement of said nozzle adjusts the position of said post relative to said discharge orifice to thereby adjust the spray pattern of product discharged through said discharge orifice.

14. The dual function aerosol valve system claimed in claim 13, wherein:

a propellant flow path is defined between said aeration fitment side wall and said threaded sleeve side wall and between said aeration fitment end wall and said threaded sleeve forward wall.

15. The dual function aerosol valve system claimed in claim 14, wherein:

said adjustable nozzle defines a product flow path extending through a center portion thereof around said center post to the discharge orifice in the forward wall of said threaded sleeve.

16. The dual function aerosol valve system claimed in claim 1, wherein:

said valve cup is made of metal material.

17. The dual function aerosol valve system claimed in claim 1, wherein:

the valve cup is made of different materials to accommodate the valve assembly and different container neck finishes of a container to which said valve assembly is to be secured.

18. The dual function aerosol valve system claimed in claim 12, wherein:

the first propellant flow path defined between the first stem valve and the valve housing upper end is annular.

19. The dual function aerosol valve system claimed in claim 1, wherein:

product to be dispensed is held in a cylinder mounted in said container, and a piston reciprocable in the cylinder exerts pressure on the product to dispense it through the nozzle means assembly.

* * * * *